US012024851B2

(12) United States Patent
Konda et al.

(10) Patent No.: US 12,024,851 B2
(45) Date of Patent: Jul. 2, 2024

(54) LOADING MACHINE CONTROL DEVICE AND CONTROL METHOD

(71) Applicant: KOMATSU LTD., Tokyo (JP)

(72) Inventors: Tomoki Konda, Tokyo (JP); Kazuhiro Hatake, Tokyo (JP); Takeshi Oi, Tokyo (JP); Masanori Aizawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 679 days.

(21) Appl. No.: 17/267,061

(22) PCT Filed: Aug. 28, 2019

(86) PCT No.: PCT/JP2019/033685
§ 371 (c)(1),
(2) Date: Feb. 9, 2021

(87) PCT Pub. No.: WO2020/054418
PCT Pub. Date: Mar. 19, 2020

(65) Prior Publication Data

US 2021/0164192 A1 Jun. 3, 2021

(30) Foreign Application Priority Data

Sep. 12, 2018 (JP) ..... 2018-170738

(51) Int. Cl.
*E02F 3/43* (2006.01)
*E02F 3/32* (2006.01)
*E02F 9/20* (2006.01)

(52) U.S. Cl.
CPC ..... *E02F 3/439* (2013.01); *E02F 3/32* (2013.01); *E02F 9/2037* (2013.01); *E02F 9/2041* (2013.01)

(58) Field of Classification Search
CPC . E02F 3/439; E02F 3/32; E02F 9/2037; E02F 9/2041; E02F 9/262; E02F 9/265; E02F 9/205
See application file for complete search history.

(56) References Cited

U.S. PATENT DOCUMENTS 6,247,538 B1 6/2001 Takeda et al.
6,363,632 B1 * 4/2002 Stentz ..... E02F 9/24 701/50

(Continued)

FOREIGN PATENT DOCUMENTS

CN 104011302 A 8/2014
CN 106088178 A 11/2016

(Continued)

OTHER PUBLICATIONS

The International Search Report for the corresponding international application No. PCT/JP2019/033685, issued on Nov. 26, 2019.

*Primary Examiner* — Russell Frejd
*Assistant Examiner* — Ana D Thomas
(74) *Attorney, Agent, or Firm* — Global IP Counselors, LLP

(57) ABSTRACT

A loading machine includes a swing body and work equipment with a bucket. A control device of the loading machine includes a loading target specifying unit that specifies a position and shape of a loading target, an avoidance position specifying unit, and a movement processing unit. The avoidance position specifying unit specifies an interference avoidance position based on the position and shape of the loading target. The movement processing unit outputs an operation signal to drive only the swing body until the bucket reaches the interference avoidance position from a loading position above the loading target, to cause the bucket to move to the interference avoidance position. The movement processing unit outputs an operation signal to drive the swing body and (Continued)

the work equipment after the bucket has reached the interference avoidance position, to cause the bucket to move to an excavation position above an excavation target.

6 Claims, 7 Drawing Sheets

(56) References Cited

U.S. PATENT DOCUMENTS

| | | | |
|---|---|---|---|
| 2014/0257647 | A1 | 9/2014 | Wu et al. |
| 2014/0330490 | A1 | 11/2014 | Aoki et al. |
| 2015/0308070 | A1 | 10/2015 | Deines |
| 2018/0251956 | A1 | 9/2018 | Hoshaku et al. |
| 2018/0347147 | A1 | 12/2018 | Doi et al. |
| 2020/0299929 | A1 | 9/2020 | Ohiwa et al. |

FOREIGN PATENT DOCUMENTS

| | | | | |
|---|---|---|---|---|
| EP | 3 399 109 | A1 | | 11/2018 |
| JP | 63-93936 | A | | 4/1988 |
| JP | 9-256407 | A | | 9/1997 |
| JP | 10-88625 | A | | 4/1998 |
| JP | 10-204931 | A | | 8/1998 |
| JP | 11-190042 | A | | 7/1999 |
| JP | 2006-307436 | A | | 11/2006 |
| JP | 2006307436 | A | * | 11/2006 |
| JP | 2016-089559 | A | | 5/2016 |
| JP | 2017-044027 | A | | 3/2017 |
| JP | 2017-227012 | A | | 12/2017 |
| JP | 2018-24997 | A | | 2/2018 |
| JP | 2018-199989 | A | | 12/2018 |
| WO | 2017/115809 | A1 | | 7/2017 |

* cited by examiner

LOADING MACHINE CONTROL DEVICE AND CONTROL METHOD

CROSS-REFERENCE TO RELATED APPLICATIONS

This application is a U.S. National stage application of International Application No. PCT/JP2019/033685, filed on Aug. 28, 2019. This U.S. National stage application claims priority under 35 U.S.C. § 119(a) to Japanese Patent Application No. 2018-170738, filed in Japan on Sep. 12, 2018, the entire contents of which are hereby incorporated herein by reference.

BACKGROUND

Field of the Invention

The present invention relates to a control device and a control method for a loading machine.

Background Information

Japanese Unexamined Patent Application, First Publication No. H09-256407 discloses a technique relating to automatic loading control of a loading machine. In the automatic loading control, a control device receives a specified loading point from an operator or the like of the loading machine, and the control device controls the motion of the loading machine and work equipment to cause a bucket to move to the loading point. According to the technique described in Japanese Unexamined Patent Application, First Publication No. H09-256407, the control device stores a time series of the positions of the work equipment in advance to cause the work equipment to be operated according to the time series.

SUMMARY

According to the technique described in Japanese Unexamined Patent Application, First Publication No. H09-256407, the work equipment automatically moves to the loading point stored in advance, and earth is dumped at the loading point. There is a demand that the work equipment automatically moves to an excavation point after the earth is dumped at the loading point. At this time, the work equipment is required to move such that the bucket does not interfere with a loading target.

An object of the present invention is to provide a control device and a control method for a loading machine, which can cause a bucket to move to an excavation point such that a loading target and the bucket do not interfere with each other.

According to a first aspect of the present invention, a control device of a loading machine is provided including a swing body that swings around a center of swing and work equipment that includes a bucket and is attached to the swing body, the device including: a loading target specifying unit that specifies a position and shape of a loading target; an avoidance position specifying unit that specifies an interference avoidance position which is located outward from the loading target by a predetermined distance, based on the position and shape of the loading target; and a movement processing unit that outputs an operation signal to drive only the swing body until the bucket reaches the interference avoidance position from a loading position above the loading target, to cause the bucket to move to the interference avoidance position, and outputs an operation signal to drive the swing body and the work equipment after the bucket has reached the interference avoidance position, to cause the bucket to move to an excavation position above an excavation target.

According to at least one of the above aspects, the control device of the loading machine can cause the bucket to move to an excavation point while preventing interference between the loading target and the bucket.

DETAILED DESCRIPTION OF EMBODIMENT(S)

Hereinafter, an embodiment will be described in detail with reference to the drawings.

First Embodiment (Configuration of Loading Machine)

Figure 1:
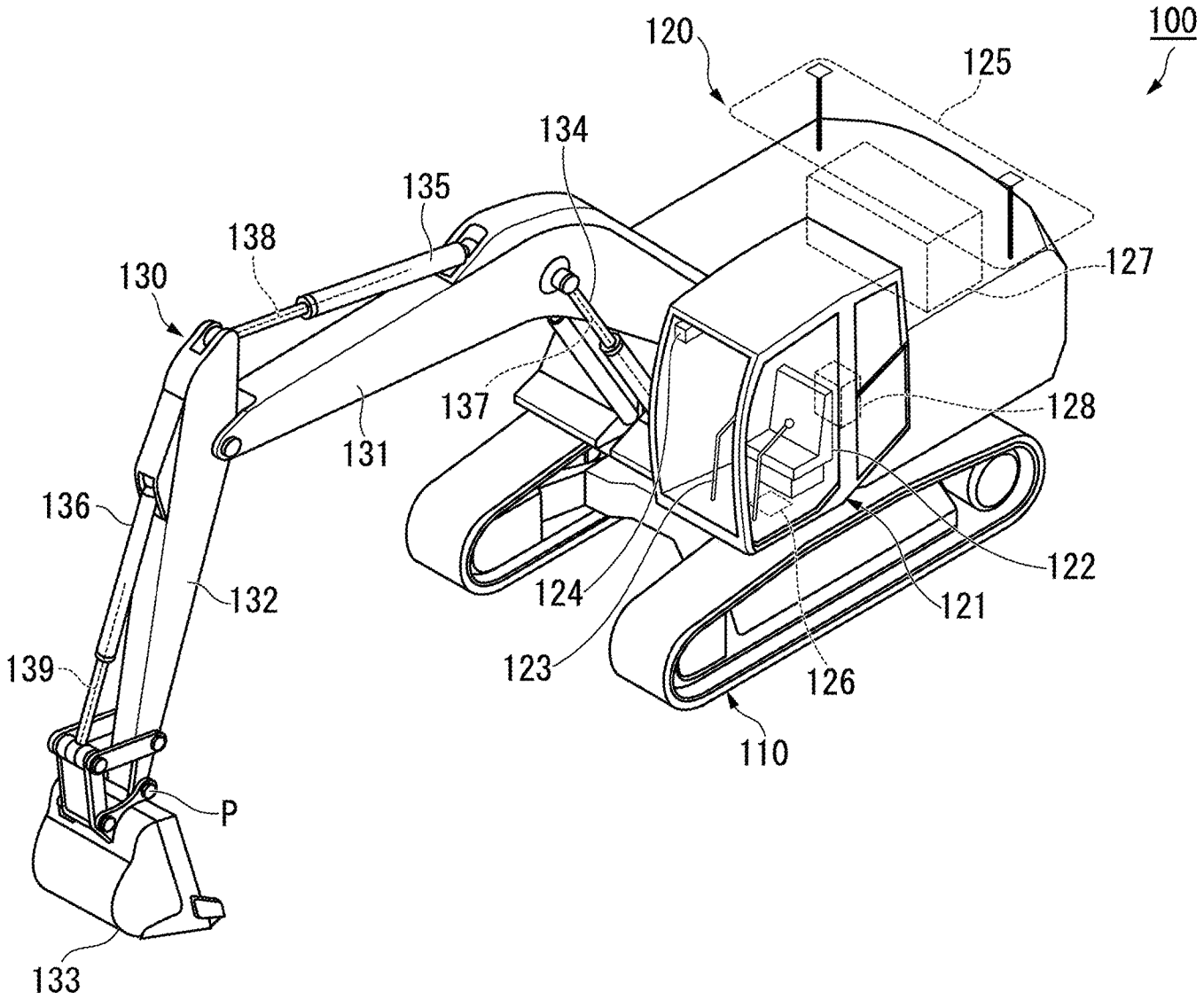
FIG. 1 is a schematic view illustrating a configuration of a loading machine according to a first embodiment.

FIG. 1 is a schematic view illustrating a configuration of a loading machine according to a first embodiment.

A loading machine 100 is a work machine that loads earth to a loading point such as a transport vehicle. The loading machine 100 according to the first embodiment is a hydraulic excavator. Incidentally, the loading machine 100 according to another embodiment may be a loading machine other than the hydraulic excavator. In addition, the loading machine 100 illustrated in FIG. 1 is a backhoe excavator, but may be a face excavator or a rope excavator.

The loading machine 100 includes an undercarriage 110, a swing body 120 supported by the undercarriage 110, and work equipment 130 that is driven by hydraulic pressure and is supported by the swing body 120. The swing body 120 is supported so as to be swingable around the center of swing.

The work equipment 130 includes a boom 131, an arm 132, a bucket 133, a boom cylinder 134, an arm cylinder 135, a bucket cylinder 136, a boom stroke sensor 137, an arm stroke sensor 138, and a bucket stroke sensor 139.

A proximal end portion of the boom 131 is attached to the swing body 120 via a pin.

The arm 132 connects the boom 131 and the bucket 133. A proximal end portion of the arm 132 is attached to a tip end portion of the boom 131 via a pin.

The bucket 133 includes a blade that excavates earth or the like and a container that carries the excavated earth. A proximal end portion of the bucket 133 is attached to a tip end portion of the arm 132 via a pin.

The boom cylinder 134 is a hydraulic cylinder that operates the boom 131. A proximal end portion of the boom cylinder 134 is attached to the swing body 120. A tip end portion of the boom cylinder 134 is attached to the boom 131.

The arm cylinder 135 is a hydraulic cylinder that drives the arm 132. A proximal end portion of the arm cylinder 135 is attached to the boom 131. A tip end portion of the arm cylinder 135 is attached to the arm 132.

The bucket cylinder 136 is a hydraulic cylinder that drives the bucket 133. A proximal end portion of the bucket cylinder 136 is attached to the arm 132. A tip end portion of the bucket cylinder 136 is attached to a link mechanism that rotates the bucket 133.

The boom stroke sensor 137 measures the stroke amount of the boom cylinder 134. The stroke amount of the boom cylinder 134 can be converted into the inclination angle of the boom 131 with respect to the swing body 120. Hereinafter, the inclination angle with respect to the swing body 120 is also referred to as an absolute angle. Namely, the stroke amount of the boom cylinder 134 can be converted into the absolute angle of the boom 131.

The arm stroke sensor 138 measures the stroke amount of the arm cylinder 135. The stroke amount of the arm cylinder 135 can be converted into the inclination angle of the arm 132 with respect to the boom 131. Hereinafter, the inclination angle of the arm 132 with respect to the boom 131 is also referred to as a relative angle of the arm 132.

The bucket stroke sensor 139 measures the stroke amount of the bucket cylinder 136. The stroke amount of the bucket cylinder 136 can be converted into the inclination angle of the bucket 133 with respect to the arm 132. Hereinafter, the inclination angle of the bucket 133 with respect to the arm 132 is also referred to as a relative angle of the bucket 133.

Incidentally, the loading machine 100 according to another embodiment may include angle sensors that detect an inclination angle with respect to the ground surface or an inclination angle with respect to the swing body 120, instead of the boom stroke sensor 137, the arm stroke sensor 138, and the bucket stroke sensor 139.

The swing body 120 is provided with a cab 121. An operator seat 122 in which an operator sits, an operation device 123 that operates the loading machine 100, and a detection device 124 that detects the three-dimensional position of an object existing in a detection direction are provided inside the cab 121. The operation device 123 generates a raising operation signal and a lowering operation signal for the boom 131, a push operation signal and a pull operation signal for the arm 132, a dump operation signal and an excavation operation signal for the bucket 133, and rightward and leftward swing operation signals for the swing body 120 in response to an operation of the operator, to output the generated signals to a control device 128. In addition, the operation device 123 generates an excavation and loading instruction signal to cause the work equipment 130 to start automatic excavation and loading control in response to an operation of the operator and outputs the generated excavation and loading instruction signal to the control device 128. The automatic excavation and loading control is control that causes automatic execution of a series of motions including the swing of the swing body 120 to move the work equipment 130 to an excavation point, the excavation of earth at the excavation point, and the swing of the swing body 120 to load the earth, which is contained in the bucket 133, into a loading target 200 (for example, a transport vehicle or a hopper).

The operation device 123 includes, for example, a lever, a switch and a pedal. The excavation and loading instruction signal is generated by operating a switch for automatic control. For example, when the switch is turned on, the excavation and loading instruction signal is output. The operation device 123 is disposed in the vicinity of the operator seat 122. The operation device 123 is located within a range where the operator can operate the operation device 123 when the operator sits in the operator seat 122.

Examples of the detection device 124 include a stereo camera, a LiDAR device, a laser scanner, and the like. The detection device 124 is provided, for example, such that the detection direction thereof faces the front of the cab 121 of the loading machine 100. The detection device 124 specifies the three-dimensional position of an object in a coordinate system with respect to the position of the detection device 124.

Incidentally, the loading machine 100 according to the first embodiment takes a motion according to an operation of the operator sitting in the operator seat 122; however, the present invention is not limited thereto in another embodiment. For example, the loading machine 100 according to another embodiment may take a motion by receiving an operation signal or an excavation and loading instruction signal transmitted by a remote operation of the operator performing operation outside the loading machine 100.

The loading machine 100 includes a position and azimuth direction calculator 125, an inclination measurement instrument 126, a hydraulic device 127, and the control device 128.

The position and azimuth direction calculator 125 calculates the position of the swing body 120 and the azimuth direction of the swing body 120. The position and azimuth direction calculator 125 includes two receivers that receive positioning signals from artificial satellites forming the GNSS. The two receivers are installed at different positions on the swing body 120. The position and azimuth direction calculator 125 detects the position of a representative point of the swing body 120 in a site coordinate system (origin of an excavator coordinate system) based on the positioning signals received by the receivers.

The position and azimuth direction calculator 125 uses the positioning signals, which are received by the two receivers, to calculate the azimuth direction of the swing body 120 as a relationship between the installation position of one receiver and the installation position of the other receiver. The azimuth direction of the swing body 120 is the front direction of the swing body 120 and is equal to a horizontal component of the extending direction of a straight line extending from the boom 131 to the bucket 133 of the work equipment 130.

The inclination measurement instrument 126 measures the acceleration and angular speed of the swing body 120 to detect the posture (for example, the roll angle and the pitch angle) of the swing body 120 based on a measurement result. The inclination measurement instrument 126 is installed, for example, on a lower surface of the swing body 120. For example, an inertial measurement unit (IMU) can be used as the inclination measurement instrument 126.

The hydraulic device 127 includes a hydraulic oil tank, a hydraulic pump, and a flow rate control valve. The hydraulic pump is driven by power of an engine (unillustrated) to supply a hydraulic oil to a travel hydraulic motor (unillustrated) that causes the undercarriage 110 to travel, a swing hydraulic motor (unillustrated) that swings the swing body 120, the boom cylinder 134, the arm cylinder 135, and the bucket cylinder 136 via the flow rate control valve. The flow rate control valve includes a spool having a rod shape, and adjusts the flow rate of the hydraulic oil to be supplied to the travel hydraulic motor, the swing hydraulic motor, the boom cylinder 134, the arm cylinder 135, and the bucket cylinder 136. The spool is driven according to a control command received from the control device 128. Namely, the amount of the hydraulic oil to be supplied to the travel hydraulic motor, the swing hydraulic motor, the boom cylinder 134, the arm cylinder 135, and the bucket cylinder 136 is controlled by the control device 128. As described above, the boom cylinder 134, the arm cylinder 135, and the bucket cylinder 136 are driven by the hydraulic oil supplied from the hydraulic device 127 that is common.

The control device 128 receives an operation signal from the operation device 123. The control device 128 drives the work equipment 130, the swing body 120, or the undercarriage 110 according to the received operation signal.

(Configuration of Control Device)

Figure 2:
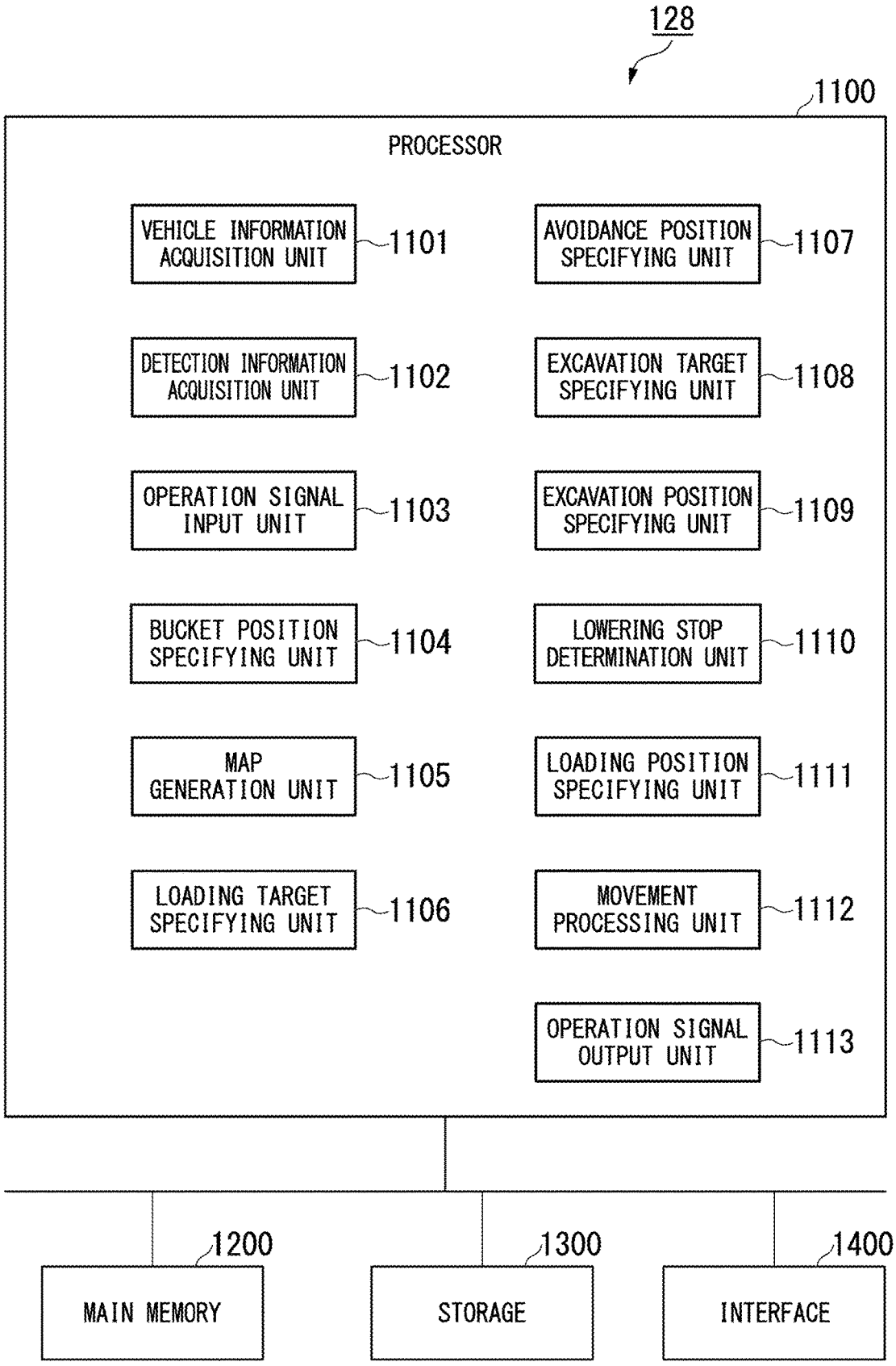
FIG. 2 is a schematic block diagram illustrating a configuration of a control device according to the first embodiment.

FIG. 2 is a schematic block diagram illustrating a configuration of the control device according to the first embodiment.

The control device 128 is a computer including a processor 1100, a main memory 1200, a storage 1300, and an interface 1400. The storage 1300 stores a program. The processor 1100 reads the program from the storage 1300 to deploy the program in the main memory 1200 and to then execute a process according to the program.

Examples of the storage 1300 include a HDD, a SSD, a magnetic disk, a magneto-optical disk, a CD-ROM, a DVD-ROM and the like. The storage 1300 may be an internal medium directly connected to a common communication line of the control device 128, or may be an external medium connected to the control device 128 via the interface 1400. The storage 1300 is a non-transitory type storage medium.

The processor 1100 executes the program and includes a vehicle information acquisition unit 1101, a detection information acquisition unit 1102, an operation signal input unit 1103, a bucket position specifying unit 1104, a map generation unit 1105, a loading target specifying unit 1106, an avoidance position specifying unit 1107, an excavation target specifying unit 1108, an excavation position specifying unit 1109, a lowering stop determination unit 1110, a loading position specifying unit 1111, a movement processing unit 1112, and an operation signal output unit 1113.

The vehicle information acquisition unit 1101 acquires, for example, the swing speed, position, and azimuth direction of the swing body 120, the inclination angles of the boom 131, the arm 132, and the bucket 133, and the posture of the swing body 120. Hereinafter, information regarding the loading machine 100 acquired by the vehicle information acquisition unit 1101 is referred to as vehicle information.

The detection information acquisition unit 1102 acquires depth information from the detection device 124. The depth information indicates the three-dimensional positions of a plurality of points within a detection range R. Examples of the depth information include a depth image formed of a plurality of pixels representing depths, and point cloud data formed of a plurality of points represented by a Cartesian coordinate system (x, y, z).

The operation signal input unit 1103 receives an input of an operation signal from the operation device 123. The operation signal includes a raising operation signal and a lowering operation signal for the boom 131, a push operation signal and a pull operation signal for the arm 132, a dump operation signal and an excavation operation signal for the bucket 133, a swing operation signal for the swing body 120, a travel operation signal for the undercarriage 110, and an excavation and loading instruction signal for the loading machine 100.

Figure 3:
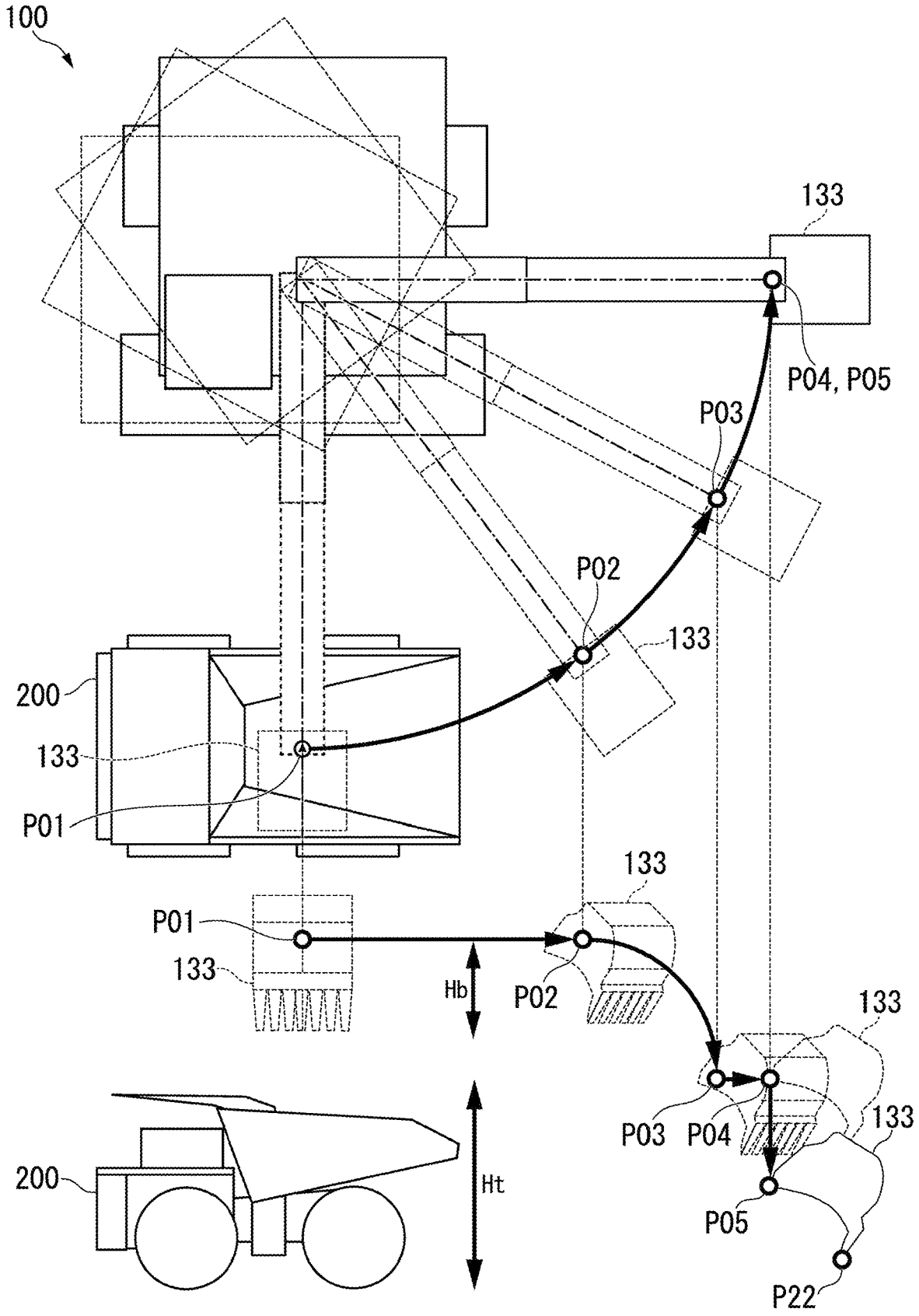
FIG. 3 is a view illustrating an example of the path of a bucket before excavation in automatic excavation and loading control according to the first embodiment.

FIG. 3 is a view illustrating an example of the path of the bucket before excavation in the automatic excavation and loading control according to the first embodiment.

The bucket position specifying unit 1104 specifies a position P (refer to FIG. 1) of the tip end portion of the arm 132 in the excavator coordinate system and a height Hb from a tip end of the arm 132 to the lowest passing point of the bucket 133 based on the vehicle information acquired by the vehicle information acquisition unit 1101. The lowest passing point of the bucket 133 refers to a point where the teeth is located when the distance between the teeth and the ground surface during a dump operation of the bucket 133 is the shortest. Namely, the height Hb from the tip end of the arm 132 to the lowest passing point of the bucket 133 coincides with the length from the pin of the proximal end portion of the bucket 133 to the teeth. Incidentally, since the proximal end portion of the bucket 133 is connected to the tip end portion of the arm 132, the position P of the tip end portion of the arm 132 is equal to the position of the proximal end portion of the bucket 133.

Specifically, the bucket position specifying unit 1104 specifies the position P of the tip end portion of the arm 132 according to the following procedure. The bucket position specifying unit 1104 obtains the position of the tip end portion of the boom 131 based on the absolute angle of the boom 131 obtained from the stroke amount of the boom cylinder 134 and the known length of the boom 131 (distance from the pin of the proximal end portion to the pin of the tip end portion). The bucket position specifying unit 1104 obtains the absolute angle of the arm 132 based on the absolute angle of the boom 131 and the relative angle of the arm 132 obtained from the stroke amount of the arm cylinder 135. The bucket position specifying unit 1104 obtains the position P of the tip end portion of the arm 132 based on the position of the tip end portion of the boom 131, the absolute angle of the arm 132, and the known length of the arm 132 (distance from the pin of the proximal end portion to the pin of the tip end portion).

The map generation unit 1105 generates a three-dimensional map representing the shape of at least a portion around the loading machine 100 in the site coordinate system, based on the position, azimuth direction, and posture of the swing body 120 acquired by the vehicle information acquisition unit 1101 and the depth information acquired by the detection information acquisition unit 1102. The map generation unit 1105 superimposes a plurality of depth information, which is detected for different detection ranges by the detection device 124 when the swing body 120 swings, to generate a three-dimensional map including the loading target 200 and an excavation target. Incidentally, in another embodiment, the map generation unit 1105 may generate a three-dimensional map in the excavator coordinate system with respect to the swing body 120.

The loading target specifying unit 1106 specifies the position and shape of the loading target 200 based on the three-dimensional map generated by the map generation unit 1105. For example, the loading target specifying unit 1106 matches a three-dimensional shape illustrated by the three-dimensional map to the known shape of the loading target 200 to specify the position and shape of the loading target 200.

The avoidance position specifying unit 1107 specifies an interference avoidance position P02 which is a point where the work equipment 130 and the loading target 200 do not interfere with each other in a plan view from above, based on the position of the loading machine 100 acquired by the vehicle information acquisition unit 1101 and the position and shape of the loading target 200 specified by the loading target specifying unit 1106. The interference avoidance position P02 is a position which has the same height as the position P (no-load swing start position P01) of the tip end of the arm 132 at the start of the automatic excavation and loading control, to which the distance from the center of swing of the swing body 120 is equal to the distance from the center of swing to the no-load swing start position P01, and below which the loading target 200 does not exist. For example, the avoidance position specifying unit 1107 specifies a circle having the center of swing of the swing body 120 as a center and having the distance between the center of swing and the no-load swing start position P01 as a radius, to specify a position, at which the outer shape of the bucket 133 does not interfere with the loading target 200 in a plan view from above and which is the closest to the no-load swing start position P01, among positions on the circle as the interference avoidance position P02. The avoidance position specifying unit 1107 can determine whether or not the loading target 200 and the bucket 133 interfere with each other, based on the position and shape of the loading target 200 and the known shape of the bucket 133. Here, "the same height" and "equal distance" are not necessarily limited to a case where the heights or the distances completely coincide with each other and allow some errors and margins.

The excavation target specifying unit 1108 specifies the position of an excavation point P22 of the excavation target based on the three-dimensional map generated by the map generation unit 1105. The excavation point P22 is, for example, a point from the teeth of the bucket 133 are moved in an excavation direction of the arm 132 and the bucket 133, so that the amount of earth corresponding to the maximum capacity of the bucket 133 can be excavated at the point. For example, the excavation target specifying unit 1108 specifies the distribution of earth of the excavation target from the three-dimensional shape illustrated by the three-dimensional map and specifies the excavation point P22 based on the distribution.

The excavation position specifying unit 1109 specifies a point which is apart from the excavation point P22 specified by the excavation target specifying unit 1108 by the distance from the proximal end portion to the teeth of the bucket 133, as an excavation position P05. Namely, in a case where the bucket 133 takes a predetermined excavation posture where the teeth faces a dump direction, when the teeth of the bucket 133 is located at the excavation point P22, the tip end of the arm 132 is located at the excavation position P05. Since the excavation point P22 is specified based on the three-dimensional map, it can be said that the excavation position specifying unit 1109 specifies the excavation position P05 based on the detection result of the detection device 124. Incidentally, in another embodiment, the excavation position specifying unit 1109 may specify the excavation position P05 according to an instruction of the operator of the loading machine 100. For example, the operator may put the bucket 133 at the excavation position P05 to press a predetermined button and to thus instruct the excavation position P05, or may use an input device such as a touch panel to instruct the excavation position P05.

In addition, the excavation position specifying unit 1109 determines a position, which is located above the excavation position P05 by a predetermined height, as a swing end position P04.

The lowering stop determination unit 1110 determines whether or not the height of the tip end of the arm 132 is the same height as the swing end position P04 when the lowering operation of the work equipment 130 is performed at the same time no-load swing of the swing body 120 is performed. The position of the tip end of the arm 132 at this time is referred to as a lowering stop position P03.

The loading position specifying unit 1111 specifies a loading position P07 based on the position and shape of the loading target 200 specified by the loading target specifying unit 1106. Specifically, the loading position specifying unit 1111 specifies the loading position P07 as follows.

Figure 4:
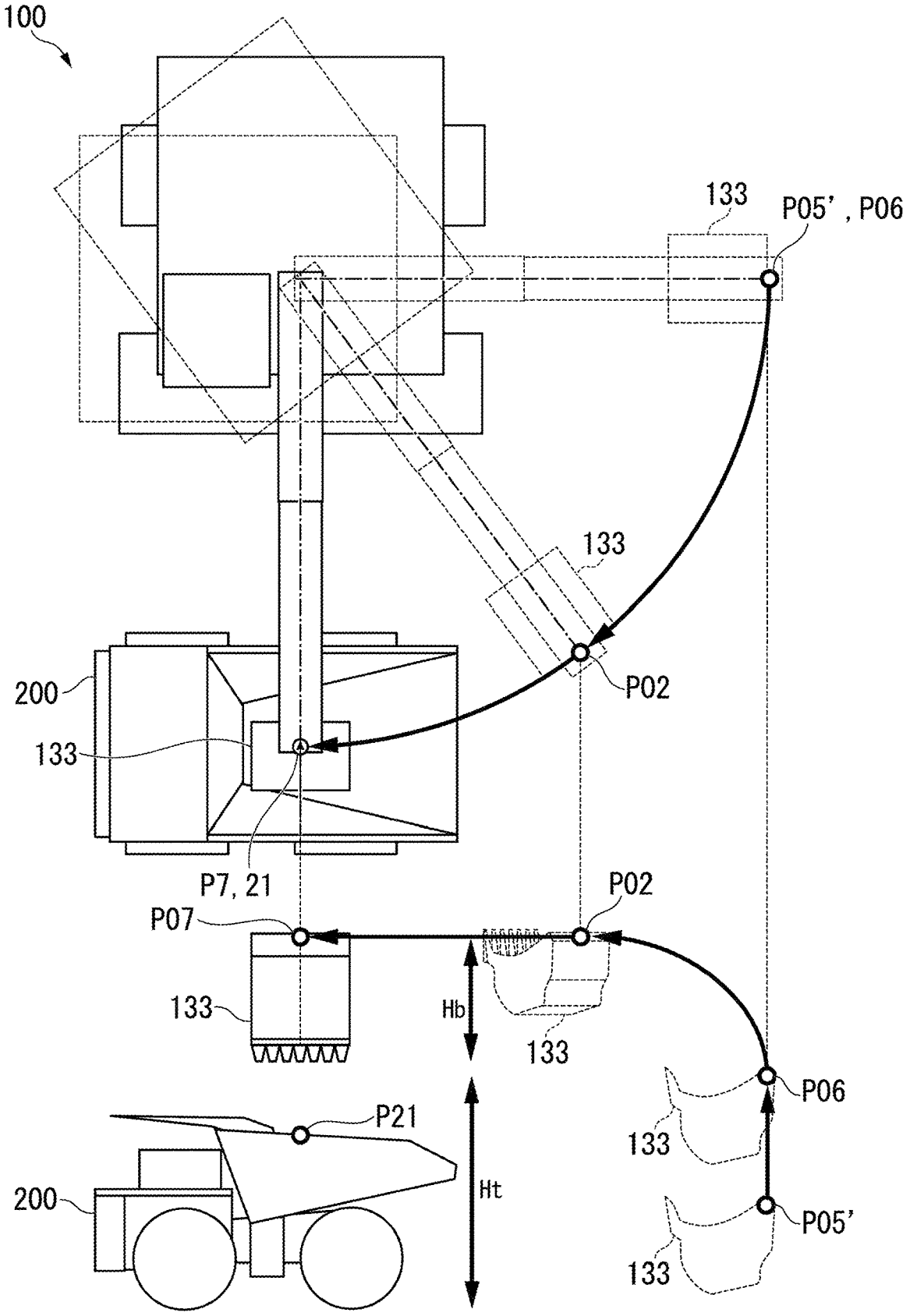
FIG. 4 is a view illustrating an example of the path of the bucket after excavation in the automatic excavation and loading control according to the first embodiment.

FIG. 4 is a view illustrating an example of the path of the bucket after excavation in the automatic excavation and loading control according to the first embodiment.

The loading position specifying unit 1111 specifies a loading point P21 above the loading target 200 as the plane position of the loading position P07. Namely, when the tip end of the arm 132 is located at the loading position P07, the tip end of the arm 132 is located above the loading point P21. Examples of the loading point P21 include the center point of a vessel when the loading target 200 is a dump truck, and the center point of an opening when the loading target 200 is a hopper. The loading position specifying unit 1111 adds the height Hb from the tip end of the arm 132 to the lowest passing point of the bucket 133, the height Hb being specified by the bucket position specifying unit 1104, and the height of a control margin of the bucket 133 to a height Ht of the loading target 200 to specify the height of the loading position P07. Incidentally, in another embodiment, the loading position specifying unit 1111 may specify the loading position P07 without adding the height of the control margin. Namely, the loading position specifying unit 1111 may add the height Hb to the height Ht to specify the height of the loading position P07. Incidentally, the height Ht according to the first embodiment is a height from the ground to an upper surface of the vessel.

When the operation signal input unit 1103 receives an input of the excavation and loading instruction signal, the movement processing unit 1112 generates a rotation operation signal to cause the bucket 133 to move to the excavation position P05, based on the excavation position P05 specified by the excavation position specifying unit 1109 and the interference avoidance position P02 specified by the avoidance position specifying unit 1107. Namely, the movement processing unit 1112 generates a rotation operation signal such that the bucket 133 reaches the excavation position P05 from the no-load swing start position P01 via the interference avoidance position P02, the lowering stop position P03, and the swing end position P04. When the bucket 133 reaches the excavation position P05, the movement processing unit 1112 generates an excavation operation signal to cause the bucket 133 to rotate or move in the excavation direction.

The movement processing unit 1112 generates a rotation operation signal to cause the bucket 133 to move to the loading position P07 based on the loading position P07 specified by the loading position specifying unit 1111 and the interference avoidance position P02 specified by the avoidance position specifying unit 1107. Namely, the movement processing unit 1112 generates a rotation operation signal to cause the bucket 133 to reach the loading position P07 from an excavation completion position P05' via a load swing start position P06 and the interference avoidance position P02. At this time, the movement processing unit 1112 generates the rotation operation signal for the bucket 133 such that the ground angle of the bucket 133 is not changed even when the boom 131 and the arm 132 are driven. When the bucket 133 reaches the loading position P07, the movement processing unit 1112 generates a dump operation signal to cause the bucket 133 to rotate in the dump direction.

The operation signal output unit 1113 outputs the operation signal input to the operation signal input unit 1103 or the operation signal generated by the movement processing unit 1112. Specifically, the operation signal output unit 1113 outputs the operation signal related to automatic control generated by the movement processing unit 1112 when the automatic excavation and loading control is in progress and outputs the operation signal related to a manual operation of the operator input to the operation signal input unit 1103 when the automatic excavation and loading control is not in progress.

(Automatic Excavation and Loading Control)

When the operator of the loading machine 100 determines that the loading machine 100 and the loading target 200 are in a positional relationship where a loading process can be performed, the operator turns on the switch for automatic control of the operation device 123. Accordingly, the operation device 123 generates and outputs the excavation and loading instruction signal.

Figure 5:
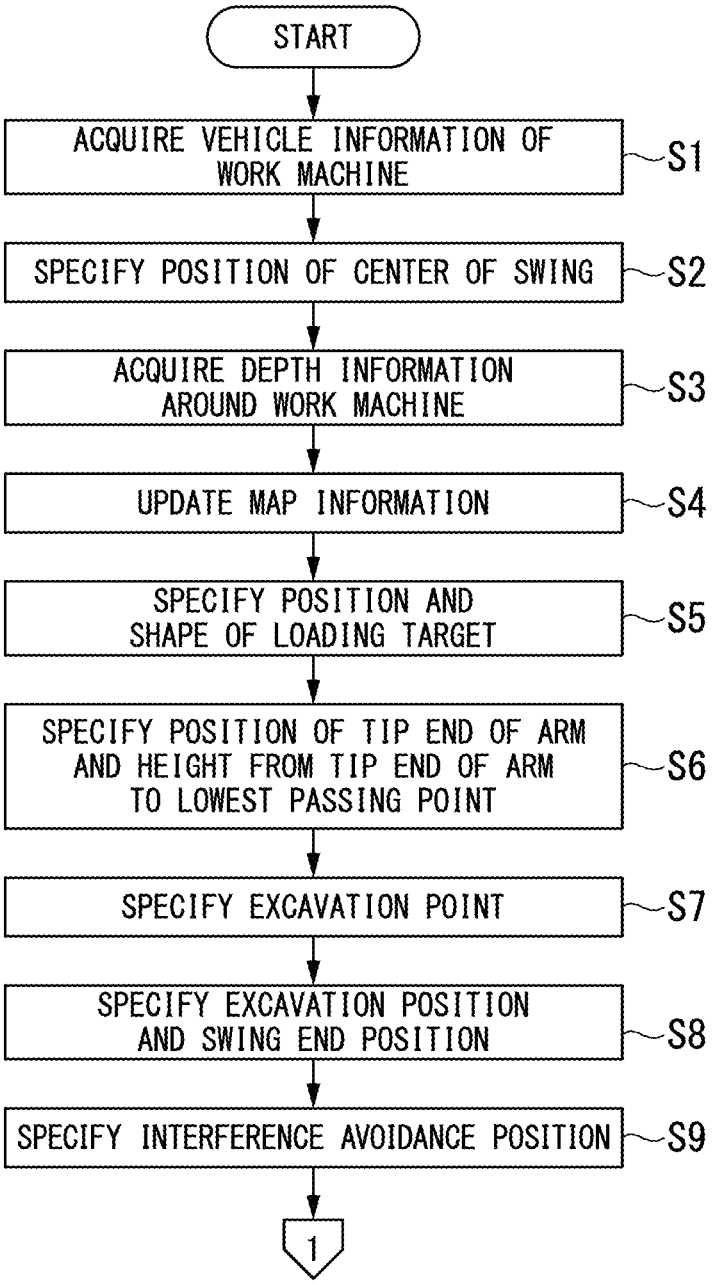
FIG. 5 is a flowchart illustrating the automatic excavation and loading control according to the first embodiment.
Figure 6:
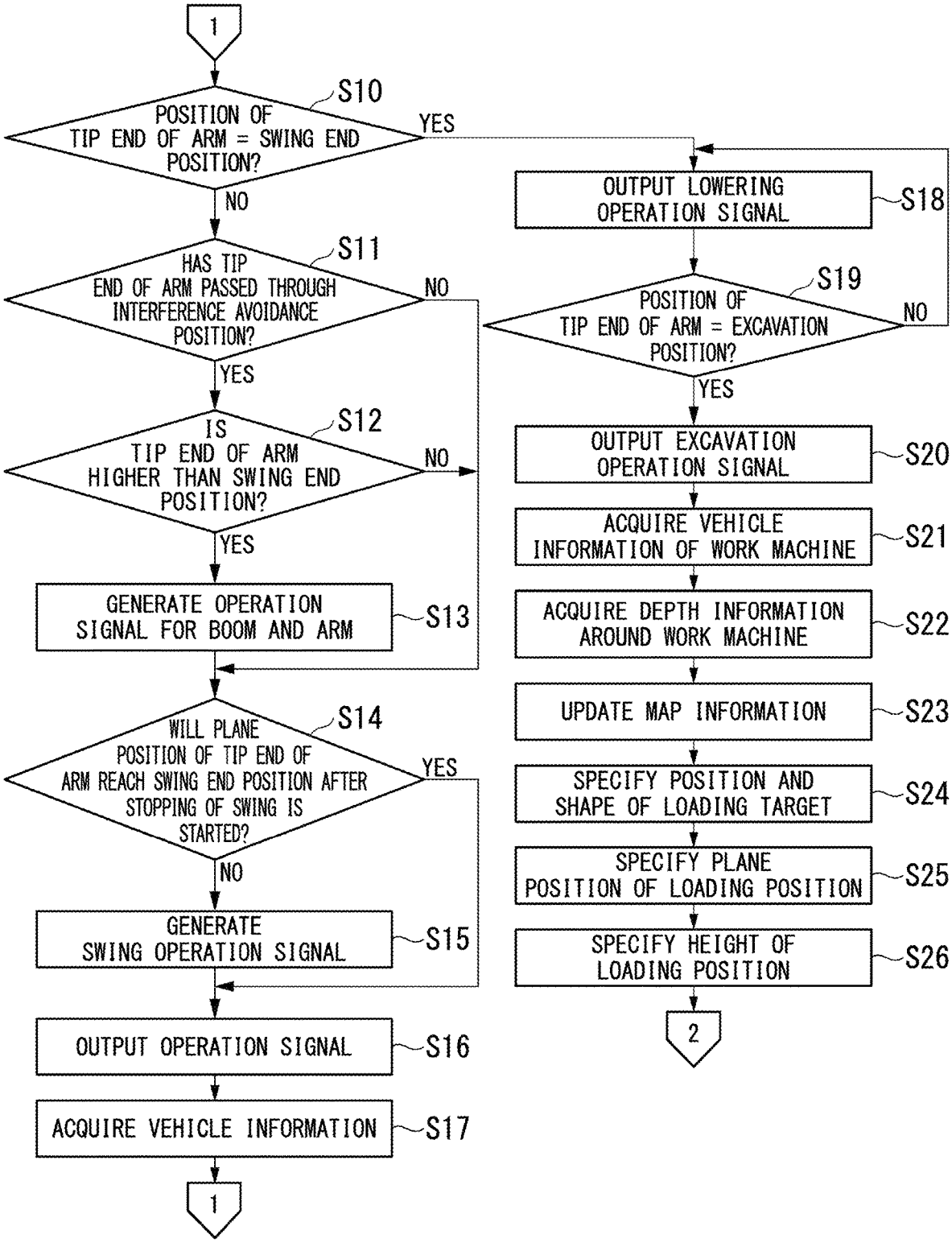
FIG. 6 is a flowchart illustrating the automatic excavation and loading control according to the first embodiment.
Figure 7:
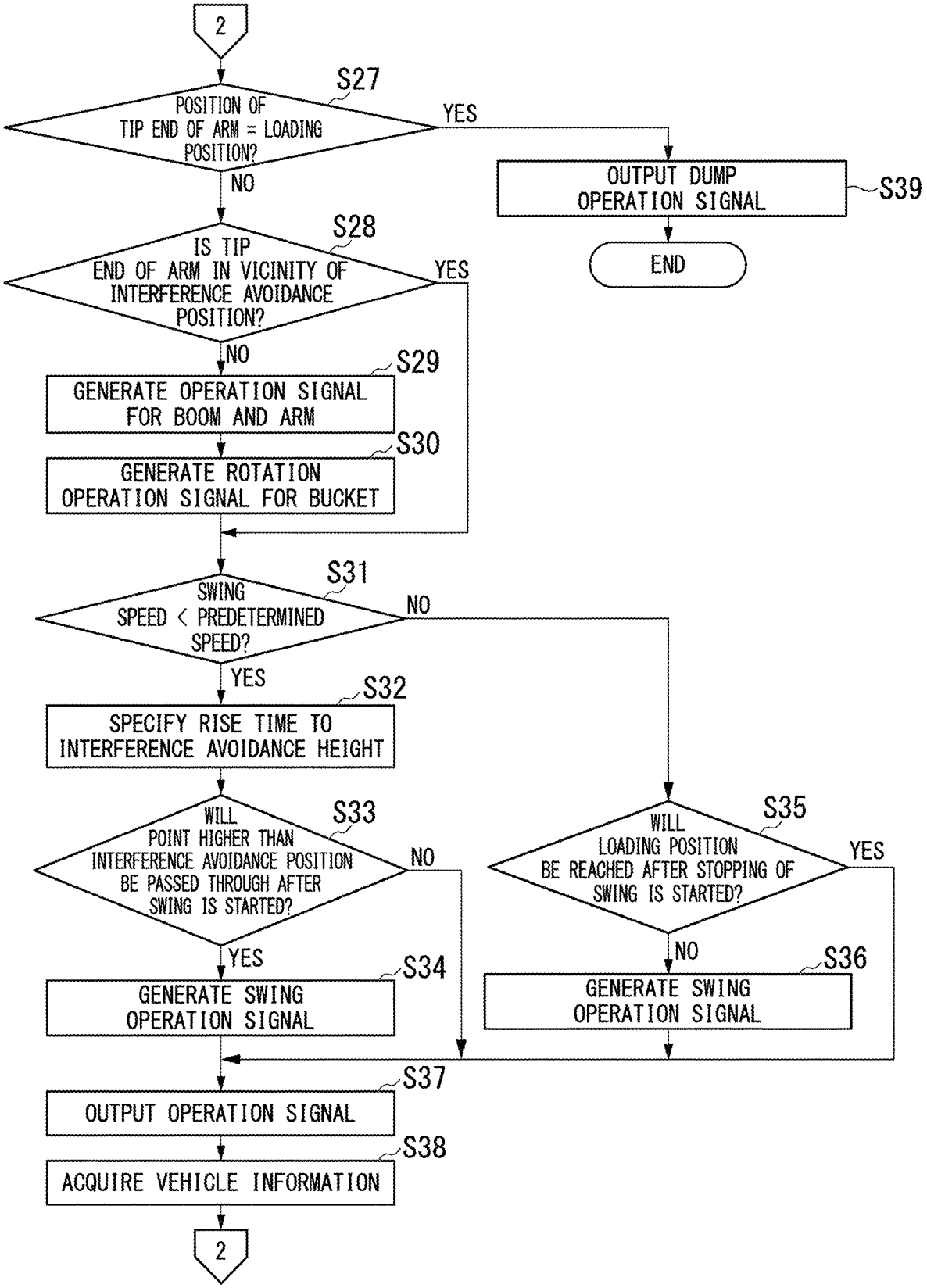
FIG. 7 is a flowchart illustrating the automatic excavation and loading control according to the first embodiment.

FIGS. 5 and 7 are flowcharts illustrating the automatic excavation and loading control according to the first embodiment. When the control device 128 receives an input of the excavation and loading instruction signal from the operator, the control device 128 executes the automatic excavation and loading control illustrated in FIGS. 5 to 7. Incidentally, the no-load swing start position P01, which is the position of the bucket 133 at the start of the automatic excavation, is a position above the loading target 200 and the position does not interfere with the loading target 200 during swing. When the automatic excavation and loading control is continuously executed, the no-load swing start position P01 coincides with the loading position P07.

The vehicle information acquisition unit 1101 acquires the position and azimuth direction of the swing body 120, the inclination angles of the boom 131, the arm 132, and the bucket 133, and the posture of the swing body 120 (step S1). The vehicle information acquisition unit 1101 specifies the position of the center of swing of the swing body 120 based on the acquired position and azimuth direction of the swing body 120 (step S2).

The detection information acquisition unit 1102 acquires the depth information indicating depths around the loading machine 100 from the detection device 124 (step S3). The map generation unit 1105 updates the three-dimensional map representing the shape of at least a portion around the loading machine 100 in the site coordinate system, based on the position, azimuth direction, and posture of the swing body 120 acquired by the vehicle information acquisition unit 1101 and the depth information acquired by the detection information acquisition unit 1102 (step S4). Namely, the map generation unit 1105 superimposes the depth information detected this time on the three-dimensional map generated in the past to update the three-dimensional map. The loading target specifying unit 1106 specifies the position and shape of the loading target 200 based on the updated map information (step S5).

The bucket position specifying unit 1104 determines the position P of the tip end portion of the arm 132 when the excavation and loading instruction signal is input as the no-load swing start position P01 and specifies the height Hb from the tip end of the arm 132 to the lowest passing point of the bucket 133, based on the vehicle information acquired by the vehicle information acquisition unit 1101 (step S6).

The excavation target specifying unit 1108 specifies the excavation point P22 based on the three-dimensional map generated in step S4 (step S7). The excavation position specifying unit 1109 specifies the excavation position P05 and the swing end position P04 based on the position of the excavation point P22 specified by the excavation target specifying unit 1108 (step S8).

The avoidance position specifying unit 1107 specifies the interference avoidance position P02 based on the no-load swing start position P01 determined in step S6 and the position and shape of the loading target 200 specified by the loading target specifying unit 1106 (step S9).

The movement processing unit 1112 determines whether or not the position P of the tip end portion of the arm 132 has reached the swing end position P04 (step S10). When the position P of the tip end portion of the arm 132 has not reached the swing end position P04 (step S10: NO), the movement processing unit 1112 determines whether or not the position P of the tip end portion of the arm 132 has passed through the interference avoidance position P02 (step S11). When the position P of the tip end portion of the arm 132 has not passed through the interference avoidance position P02 (step S11: NO), the movement processing unit 1112 does not generate an operation signal for the boom 131, the arm 132, and the bucket 133. Namely, when the position P of the tip end portion of the arm 132 has not passed through the interference avoidance position P02, the movement processing unit 1112 prohibits the output of an operation signal that causes the work equipment 130 to be lowered.

On the other hand, when the position P of the tip end portion of the arm 132 has passed through the interference avoidance position P02 (step S11: YES), the lowering stop determination unit 1110 determines whether or not the position P of the tip end of the arm 132 is higher than the swing end position P04 (step S12). When the position P of the tip end of the arm 132 is higher than the swing end position P04 (step S12: YES), the movement processing unit 1112 generates an operation signal for the boom 131 and the arm 132 to cause the position P of the tip end portion of the arm 132 to be lowered (step S13).

On the other hand, when the height of the position P of the tip end of the arm 132 is the height of the swing end position P04 or less (step S13: NO), the movement processing unit 1112 temporarily stops generating an operation signal for the boom 131 and the arm 132 which causes the lowering of the position P of the tip end portion of the arm 132.

Next, the movement processing unit 1112 determines whether or not the plane position of the tip end of the arm 132 will reach the swing end position P04 when the output of the swing operation signal is stopped from the current time (step S14). In a case where the plane position of the tip end of the arm 132 will not reach the swing end position P04 when the output of the swing operation signal is stopped from the current time (step S14: NO), the movement processing unit 1112 generates the swing operation signal (step S15).

On the other hand, in a case where the plane position of the tip end of the arm 132 will reach the swing end position P04 when the output of the swing operation signal is stopped from the current time (step S14: YES), the movement processing unit 1112 does not generate the swing operation signal. Namely, in the case where the plane position of the tip end of the arm 132 reaches the swing end position P04 when the output of the swing operation signal is stopped from the current time, the movement processing unit 1112 prohibits the output of the swing operation signal. Accordingly, the swing body 120 which continues to swing due to inertia starts decelerating.

When at least one of the operation signals for the boom 131 and the arm 132 and the swing operation signal for the swing body 120 is generated in the process from step S10 to step S15, the operation signal output unit 1113 outputs the generated operation signal to the hydraulic device 127 (step S16).

Then, the vehicle information acquisition unit 1101 acquires the vehicle information (step S17). Accordingly, the vehicle information acquisition unit 1101 can acquire vehicle information after driving by the output operation signal. The control device 128 causes the process to return to step S14 to repeatedly execute the generation of an operation signal.

In step S10, when the position P of the tip end portion of the arm 132 has reached the swing end position P04 (step S10: YES), the movement processing unit 1112 generates an operation signal to cause the boom 131 and the arm 132 to be lowered, and the operation signal output unit 1113 outputs the generated operation signal to the hydraulic device 127 (step S18). The vehicle information acquisition unit 1101 acquires the vehicle information to determine whether or not the position P of the tip end portion of the arm 132 has reached the excavation position P05 (step S19). When the position P of the tip end portion of the arm 132 has not reached the excavation position P05 (step S19: NO), the control device 128 causes the process to return to step S22 to continue to output an operation signal that causes the work equipment 130 to be lowered. Therefore, the swing body 120 does not swing while the position P of the tip end portion of the arm 132 is moved from the swing end position P04 to the excavation position P05.

When the position P of the tip end portion of the arm 132 has reached the excavation position P05 (step S19: YES), the movement processing unit 1112 generates an excavation operation signal to cause the bucket 133 to be driven in the excavation direction, and the operation signal output unit 1113 outputs the generated operation signal to the hydraulic device 127 (step S20). Accordingly, the control device 128 can cause the bucket 133 to excavate the excavation target.

Next, the vehicle information acquisition unit 1101 acquires vehicle information (step S21). In addition, the detection information acquisition unit 1102 acquires depth information indicating depths around the loading machine 100 from the detection device 124 (step S22). The map generation unit 1105 updates the three-dimensional map based on the vehicle information acquired by the vehicle information acquisition unit 1101 and the depth information acquired by the detection information acquisition unit 1102 (step S23). The loading target specifying unit 1106 specifies the position and shape of the loading target 200 based on the updated three-dimensional map (step S24). The loading position specifying unit 1111 specifies the plane position of the loading position P07 based on the position and shape of the loading target 200 specified by the loading target specifying unit 1106 (step S25). The loading position specifying unit 1111 adds the height Hb from the tip end portion of the arm 132 to the lowest passing point of the bucket 133 specified in step S6 and the height of a control margin of the bucket 133 to the height Ht of the loading target 200 to specify the height of the loading position P07 (step S26).

The movement processing unit 1112 determines whether or not the position P of the tip end portion of the arm 132 has reached the loading position P07 (step S27). When the position P of the tip end portion of the arm 132 has not reached the loading position P07 (step S27: NO), the movement processing unit 1112 determines whether or not the position P of the tip end portion of the arm 132 is in the vicinity of the interference avoidance position P02 (step S28). For example, the movement processing unit 1112 determines whether or not a difference between the height of the tip end of the arm 132 and the height of the interference avoidance position P02 is less than a predetermined threshold value, or a difference between the plane distance from the center of swing of the swing body 120 to the tip end of the arm 132 and the plane distance from the center of swing to the interference avoidance position P02 is less than a predetermined threshold value (step S28). When the position P of the tip end portion of the arm 132 is not in the vicinity of the interference avoidance position P02 (step S28: NO), the movement processing unit 1112 generates an operation signal to cause the boom 131 and the arm 132 to be raised to the height of the interference avoidance position P02 (step S29). At this time, the movement processing unit 1112 generates an operation signal based on the positions and speeds of the boom 131 and the arm 132.

In addition, the movement processing unit 1112 calculates the sum of the angular speeds of the boom 131 and the arm 132 based on the generated operation signal for the boom 131 and the arm 132 and generates an operation signal to cause the bucket 133 to rotate at the same speed as the sum of the angular speeds (step S30). Accordingly, the movement processing unit 1112 can generate an operation signal to cause the ground angle of the bucket 133 to be held.

When the position P of the tip end portion of the arm 132 is in the vicinity of the interference avoidance position P02 (step S28: YES), the movement processing unit 1112 does not generate an operation signal for the boom 131, the arm 132, and the bucket 133. Namely, when the position P of the tip end portion of the arm 132 is in the vicinity of the interference avoidance position P02, the movement processing unit 1112 prohibits the output of the operation signal for the work equipment 130 which causes the work equipment 130 to move to the loading point.

The movement processing unit 1112 determines whether or not the swing speed of the swing body 120 is less than a predetermined speed, based on the vehicle information acquired by the vehicle information acquisition unit 1101 (step S31). Namely, the movement processing unit 1112 determines whether or not the swing of the swing body 120 is in progress.

When the swing speed of the swing body 120 is less than the predetermined speed (step S31: YES), the movement processing unit 1112 specifies a rise time which is the time taken for the height of the bucket 133 to reach the height of the interference avoidance position P02 from the height of the excavation completion position P05' (step S32). The movement processing unit 1112 determines whether or not the tip end of the arm 132 will pass through the interference avoidance position P02 or a point higher than the interference avoidance position P02 when the swing operation signal is output from the current time, based on the rise time of the bucket 133 (step S33). In a case where the tip end of the arm 132 will pass through the interference avoidance position P02 or the point higher than the interference avoidance position P02 when the swing operation signal is output from the current time (step S33: YES), the movement processing unit 1112 generates the swing operation signal (step S34).

In a case where the tip end of the arm 132 passes through a point lower than the interference avoidance position P02 when the swing operation signal is output from the current time (step S33: NO), the movement processing unit 1112 does not generate the swing operation signal. Namely, when the tip end of the arm 132 passes through the point lower than the interference avoidance position P02, the movement processing unit 1112 prohibits the output of the swing operation signal.

When the swing speed of the swing body 120 is the predetermined speed or more (step S31: NO), the movement processing unit 1112 determines whether or not the tip end of the arm 132 will reach the loading position P07 when the output of the swing operation signal is stopped from the current time (step S35). Incidentally, after the output of the swing operation signal is stopped, the swing body 120 continues to swing due to inertia while decelerating, and thereafter stops. In a case where the tip end of the arm 132 will reach the loading position P07 when the output of the swing operation signal is stopped from the current time (step S35: YES), the movement processing unit 1112 does not generate the swing operation signal. Namely, in the case where the tip end of the arm 132 reaches the loading position P07 when the output of the swing operation signal is stopped from the current time, the movement processing unit 1112 prohibits the output of the swing operation signal. Accordingly, the swing body 120 starts decelerating.

On the other hand, in a case where the tip end of the arm 132 stops before the loading position P07 when the output of the swing operation signal is stopped from the current time (step S35: NO), the movement processing unit 1112 generates the swing operation signal (step S36).

When at least one of the rotation operation signals for the boom 131, the arm 132, and the bucket 133 and the swing operation signal for the swing body 120 is generated in the process from step S27 to step S36, the operation signal output unit 1113 outputs the generated operation signal to the hydraulic device 127 (step S37).

Then, the vehicle information acquisition unit 1101 acquires vehicle information (step S38). Accordingly, the vehicle information acquisition unit 1101 can acquire the vehicle information after operation by the output operation signal. The control device 128 causes the process to return to step S31 to repeatedly execute the generation of an operation signal.

On the other hand, in step S27, when the position P of the tip end portion of the arm 132 has reached the loading position P07 (step S27: YES), the movement processing unit 1112 generates the dump operation signal, and the operation signal output unit 1113 outputs the dump operation signal to the hydraulic device 127 (step S39). Accordingly, the earth contained in the bucket 133 is loaded into the loading target 200. Incidentally, when the position P of the tip end portion of the arm 132 has reached the loading position P07, the swing of the swing body 120 is stopped.

Accordingly, the control device 128 ends the automatic excavation and loading control. Alternatively, the control device 128 causes the process to return to step S1 to repeatedly execute the automatic excavation and loading control unless the loading capacity of the loading target 200 does not exceed the maximum loading capacity.

(Operation and Effects)

As described above, the control device 128 according to the first embodiment specifies the interference avoidance position P02 which is located outward from the loading target 200 by a predetermined distance, based on the position and shape of the loading target 200, to cause only the swing body 120 to be driven such that the bucket 133 reaches the interference avoidance position P02 and to thus move the bucket 133 to the interference avoidance position P02. Thereafter, the control device 128 causes the swing body 120 and the work equipment 130 to be driven, so that the bucket 133 is moved to the excavation position P05 above the excavation target. Accordingly, the control device 128 can cause the teeth of the bucket 133 to move to the excavation point P22 while preventing interference between the loading target 200 and the bucket 133.

In addition, after the bucket 133 has reached the interference avoidance position P02, the control device 128 according to the first embodiment causes the swing body 120 and the work equipment 130 to be driven, so that the bucket 133 is moved to the swing end position P04 above the excavation position P05. Thereafter, the control device 128 causes only the work equipment 130 to be driven, so that the bucket 133 is moved to the excavation position P05. Accordingly, the teeth of the bucket 133 can be brought into contact with the excavation target along a direction where the blade extends. Incidentally, when the bucket 133 hits the excavation target while swing, a lateral force is applied to the blade of the bucket 133, so that abrasion of the blade and the bending of the work equipment 130 is likely to occur.

One embodiment has been described in detail above with reference to the drawings; however, the specific configurations are not limited to those described above, and various design changes and the like can be made.

For example, in the control device 128 according to the first embodiment, the depth information is used to specify the loading point P21; however, the present invention is not limited to thereto. In the control device 128 according to another embodiment, the depth information may not be used, the loading target 200 may be provided with the position and azimuth direction calculator, and the loading target specifying unit 1106 may receive the position, azimuth direction, and shape of the loading target 200 output from the position and azimuth direction calculator of the loading target 200, so that the loading position specifying unit 1111 specifies the loading point P21.

In addition, in the control device 128 according to the first embodiment, the depth information is used to specify the excavation point P22; however, the present invention is not limited thereto. In the control device 128 according to another embodiment, the excavation position specifying unit 1109 may specify the excavation point P22 so that the operator can teach the excavation point P22. Specifically, the excavation position specifying unit 1109 may store an excavation position when the operator manually performs an excavation operation, to specify the excavation position as the excavation point P22. Alternatively, a touch panel type data input terminal device through which an instruction on the excavation point P22 is given may be provided in the cab 121, and the excavation position specifying unit 1109 may receive data, on which an instruction is given from the data input terminal device, to specify the excavation point P22.

In addition, the control device 128 according to the first embodiment performs the automatic excavation and loading control; however, the present invention is not limited thereto. The control device 128 according to another embodiment may perform automatic excavation control, and a loading operation may be manually performed by the operator.

In addition, in the control device 128 according to the first embodiment, the excavation point P22 is specified and an excavation operation is executed after a swing operation toward the excavation point P22 is performed; however, the present invention is not limited thereto, and the control device 128 may cause a swing operation toward the excavation point P22 to be executed to end control, and excavation work may be manually performed by the operator.

In addition, the control device 128 according to the first embodiment starts, but is not limited to, the automatic excavation and loading control at the no-load swing start position P01 where the bucket 133 is located above the loading target 200. In the control device 128 according to another embodiment, when the bucket 133 is at the excavation completion position P05' and the automatic excavation and loading control is started, the bucket 133 may pass through the interference avoidance position P02 to move to the loading position P07, and after a dump operation is performed, the bucket 133 may pass through the interference avoidance position P02 to move to the excavation point P22.

In addition, the loading target specifying unit 1106 of the control device 128 according to the first embodiment specifies the position and shape of the loading target 200 based on the map information generated from the depth information; however, the present invention is not limited thereto. For example, in another embodiment, when the loading target 200 has a positioning function by the GNSS or the like, the loading target specifying unit 1106 may receive, via vehicle-to-vehicle communication, information regarding the position and azimuth direction of the loading target 200 from the loading target 200 which has arrived at a loading point, to specify the position and shape of the loading target 200. In addition, in another embodiment, when the loading target 200 is an unmanned vehicle controlled by a control system, the loading target specifying unit 1106 may receive information regarding the position and azimuth direction of the loading target 200 from the control system to specify the position and shape of the loading target 200.

In addition, the loading machine 100 according to the first embodiment includes, but is not limited to, the bucket 133. For example, the loading machine 100 according to another embodiment may include a clam bucket that can open and close a bag-all and a clamshell.

In addition, the loading machine 100 according to the first embodiment is, but is not limited to, a manned vehicle operated by the operator who gets thereon. For example, the loading machine 100 according to another embodiment is a remote drive vehicle operating according to an operation signal acquired via communication from a remote operation device which the operator in a remote office operates while watching a screen of a monitor. In this case, a part of functions of the control device 128 may be provided in the remote operation device.

The control device of the loading machine according to the present invention can cause the bucket to move to the excavation point while preventing interference between the loading target and the bucket.

The invention claimed is:

1. A control device of a loading machine including a swing body that swings around a center of swing and work equipment that includes a bucket and is attached to the swing body, the control device comprising:

a processor configured to specify a position and shape of a loading target;

specify an interference avoidance position based on the position and shape of the loading target, the interference avoidance position being located outward from the loading target by a predetermined distance and having a height equal to a height of a no-load swing start position, the no-load swing start position being a position of a tip end of the arm at a start of an automatic excavation and loading control, a distance from the center of swing to the interference avoidance position being equal to a distance from the center of swing to the no-load swing start position, and the interference avoidance position being a position below which the loading target does not exist; and output an operation signal to drive only the swing body until the bucket reaches the interference avoidance position from a loading position above the loading target, to cause the bucket to move to the interference avoidance position, and output an operation signal to drive the swing body and the work equipment after the bucket has reached the interference avoidance position, to cause the bucket to move to an excavation position above an excavation target.

2. The control device of the loading machine according to claim 1, wherein the processor is further configured to output an operation signal to drive the swing body and the work equipment after the bucket has reached the interference avoidance position, to cause the bucket to move to a swing end position above the excavation position and output an operation signal to drive only the work equipment after the bucket has reached the swing end position, to cause the bucket to move to the excavation position.

3. The control device of the loading machine according to claim 1, wherein the loading machine includes a detection device that detects a position of an object existing in a detection direction, and the loading target specifying unit specifies the position and shape of the loading target based on a detection result of the detection device.

4. The control device of the loading machine according to claim 1, wherein the loading machine includes a detection device that detects a position of an object existing in a detection direction, and the processor is further configured to specify the excavation position based on a detection result of the detection device.

5. The control device of the loading machine according to claim 1, wherein the processor is further configured to specify the excavation position based on an instruction of an operator of the loading machine.

6. A control method for a loading machine including a swing body that swings around a center of swing and work equipment that includes a bucket and is attached to the swing body, the control method comprising:

specifying a position and shape of a loading target;

specifying an interference avoidance position based on the position and shape of the loading target, the interference avoidance position being located outward from the loading target by a predetermined distance and having a height equal to a height of a no-load swing start position, the no-load swing start position being a position of a tip end of the arm at a start of an automatic excavation and loading control, a distance from the center of swing to the interference avoidance position being equal to a distance from the center of swing to the no-load swing start position, and the interference avoidance position being a position below which the loading target does not exist;

outputting an operation signal to drive only the swing body until the bucket reaches the interference avoidance position from a loading position above the loading target, to cause the bucket to move to the interference avoidance position; and outputting an operation signal to drive the swing body and the work equipment after the bucket has reached the interference avoidance position, to cause the bucket to move to an excavation position above an excavation target.

* * * * *